US005428909A

United States Patent [19]

Immel

[11] Patent Number: 5,428,909

[45] Date of Patent: Jul. 4, 1995

[54] DUMP BUCKET ARCH

[75] Inventor: Darryl L. Immel, Waterford, Wis. 53185

[73] Assignee: Harnischfeger Industries, Inc., Brookfield, Wis.

[21] Appl. No.: 119,643

[22] Filed: Sep. 13, 1993

[51] Int. Cl.[6] ..... E02F 3/60

[52] U.S. Cl. ..... 37/399; 37/394; 37/397; 414/722

[58] Field of Search ..... 37/394, 395, 397, 398, 37/399; 212/242, 251; 294/68.26; 414/693, 722

[56] References Cited

U.S. PATENT DOCUMENTS

| | | | |
|---|---|---|---|
| 1,016,860 | 2/1912 | Weeks | 37/398 |
| 1,824,989 | 9/1931 | Fundom | 414/722 X |
| 1,868,246 | 7/1932 | Page | 37/398 |
| 2,120,444 | 6/1938 | Smith | 37/395 X |
| 2,359,817 | 10/1944 | Ashley | 37/398 |
| 2,525,528 | 10/1950 | Deal | 37/398 |
| 2,862,314 | 12/1958 | Larsen | 37/399 |
| 4,791,738 | 12/1988 | Briscoe | 37/399 |

FOREIGN PATENT DOCUMENTS

| | | | |
|---|---|---|---|
| 606934 | 8/1948 | United Kingdom | 37/398 |

OTHER PUBLICATIONS 25 pages from Page Engineering on Williams product catalogs.

*Primary Examiner*—Randolph A. Reese
*Assistant Examiner*—Andrea Chop
*Attorney, Agent, or Firm*—Jansson & Shupe, Ltd.

[57] ABSTRACT

A bucket arch, used on dragline buckets, has a pair of side sections and an arch center section disposed therebetween. At least one lug is attached to the arch center section and exerts a force on the center section along a force axis. In the improvement, the center section is angled with respect to the side sections and has an axis generally coincident with the force axis. Such angled center section at least greatly reduces the twisting forces imposed on the arch by the lug. Such center section also greatly reduces the wear or friction on the center section of the arch resulting from the drag chain rubbing thereon during tipping of the bucket.

7 Claims, 6 Drawing Sheets

DUMP BUCKET ARCH

FIELD OF THE INVENTION

This invention is related generally to mining of minerals and, more particularly, to dragline machines and buckets used for such mining.

BACKGROUND OF THE INVENTION

Digging machines known as draglines are widely used to remove earth "overburden" and thereby disclose and mine a mineral, e.g., coal, which is beneath or near the earth's surface. Almost invariably, draglines are used at sites remote from any well-equipped service facility or storehouse of repair parts.

Smaller draglines are crawler mounted much like a military tank and capable of movement in the same way albeit at much slower speeds. However, as draglines increased in size, crawler mounting was found to be impractical and in the early 1900's the "walking" dragline was developed. The walking dragline is so named because it takes "short steps" and uses a walk leg mechanism (which resembles a human leg) to do so. The difference is that in a walking dragline, both legs step simultaneously.

A dragline is equipped with an angularly-extending boom from which is suspended a bucket having an open mouth and digging teeth, both pointing toward the main portion of the machine. The bucket also includes a hoop-like arch (not unlike a croquet arch in shape) which provides support for the bucket and allows for manipulation of the bucket as will be discussed herein. The arch has two side sections and a center section disposed perpendicular to the side sections and attached thereto.

Overburden is removed by placing the bucket on the ground at a point distant from the machine and pulling the bucket toward the machine, filling the bucket in the process. Once the bucket is filled, the machine pivots about a central axis and the bucket is emptied at a spoil pile somewhat away from the area being excavated.

In other types of digging machines, e.g., a power shovel or backhoe, the bucket is attached to a rigid arm and can be forced through the material being removed. A dragline bucket (and the manner of bucket attachment) differ from such machines in that the dragline bucket is attached to the machine solely by flexible cables, chains and the like. Therefore, the weight of the bucket and the design and arrangement of its teeth (along with other factors) are important in configuring a dragline bucket which digs efficiently. An example of a dragline bucket is shown in U.S. Pat. No. 4,791,738 (Briscoe) and in trade literature filed with this specification.

As the dragline bucket is pulled toward the machine, it is generally horizontal for substantially complete filling. To empty the bucket, the operator actuates controls which tips such bucket to a near-vertical position with the teeth pointing downward. One component of the cable, chain and linkage arrangement connecting the bucket and the machine and used to control the bucket "attitude" or orientation is called a dump block.

A dump block is a pulley-like device which, unlike a block-and-tackle, provides no mechanical advantage but which is used to change the direction of the force exerted by a flexible cable and chain. Such dump blocks are attached to the bucket arch by at least one lug attached on the center section of the arch. In operation, as the bucket is lifted, force is applied to the arch at the lug. Such force is applied in an angled direction and causes stress in and twisting of the bucket arch. Such forces can, over time, permanently distort or even break the arch.

Additionally, when the bucket is tipped into a vertical position, the dump drag chain grates along and abrades the outer edge of the center section of the bucket arch. Such abrasion deteriorates and weakens the arch and, very possibly, results in a fracture of the arch due to the forces described above.

An improved bucket arch that minimizes the twisting or shear forces imposed on the arch and substantially reduces arch wear due to dump chain abrasion would be an important advance in the art.

OBJECTS OF THE INVENTION

It is an object of this invention to provide an improved bucket arch overcoming some of the problems and shortcomings of the prior art.

Another object of this invention is to provide an improved bucket arch in which the twisting or shear forces imposed on the arch are avoided or at least greatly reduced.

Yet another object of this invention is to provide an improved bucket arch which reduces friction and stress on the arch.

An additional object of the invention is to provide a dump bucket arch with increased longevity.

How these and other important objects are accomplished will be apparent from the following descriptions and from the drawings.

SUMMARY OF THE INVENTION

The invention is an improvement in a bucket arch, a curved, inverted U-shaped support member extending across and supporting a bucket and used in aiding and controlling the digging and dumping "attitude" of the bucket of a dragline. Common bucket arches have a pair of side sections and an arch center section disposed therebetween. The lug which secures what is known as a dump rope to the arch center section is attached to the top surface of the arch center section. The dump rope applies a force along a force axis. Such a force axis is angled with respect to an axis extending through the arch.

In the improvement, the arch center section is angled with respect to the side sections and has an axis generally coincident with the force axis. Such arrangement substantially avoids or greatly reduces the stress and twisting forces which would otherwise be applied to the arch center section. Such an angled arch center section also presents a smooth "large-area" (and, consequently, long-wearing) surface to the bucket drag chain when such chain contacts the surface during bucket dumping. This is a marked contrast to the relatively sharp arch edge presented to and contacted by the drag chain in prior art buckets. The useful lives of the chain and arch are materially extended.

The improved bucket arch has a unique orientation with respect to the force axis and with respect to the bucket itself. More specifically, the arch center section of the improved dump bucket assembly has a second axis substantially perpendicular to the first axis. In a highly preferred arrangement, the cross-sectional dimension of the bucket arch is greater along the first axis than along the second axis and, in fact, is greatest along the first axis.

The bucket has a bucket axis extending the length of the bucket and substantially parallel to the bucket floor. As oriented with respect to the bucket, the first axis of the arch is angled with respect to the bucket axis rather than parallel to the bucket axis as in prior art arrangements.

In other aspects of the invention, the arch center section has a top surface, a bottom surface and a second axis substantially normal to the first axis. The first axis is substantially parallel to at least one of the surfaces as well as being substantially coincident with the axis of the force imposed on the arch by the dump rope.

The improved bucket arch (and, specifically, its center section to which the dump rope lug is attached) may have any of several cross-sectional shapes. For example, in one embodiment, the center section is substantially rectangular in shape. In other embodiments, the center section has rounded corners and is generally elliptical or oval in shape.

Further details of the invention are set forth in the detailed description and the drawings.

DETAILED DESCRIPTIONS OF THE PREFERRED EMBODIMENTS

Before describing the inventive bucket arch 10 and to give additional perspective to the following discussion, some features of a walking dragline are presented. The exemplary dragline is one of the world's largest machines and is made by Harnischfeger Industries of Milwaukee, Wis.

Figure 1:
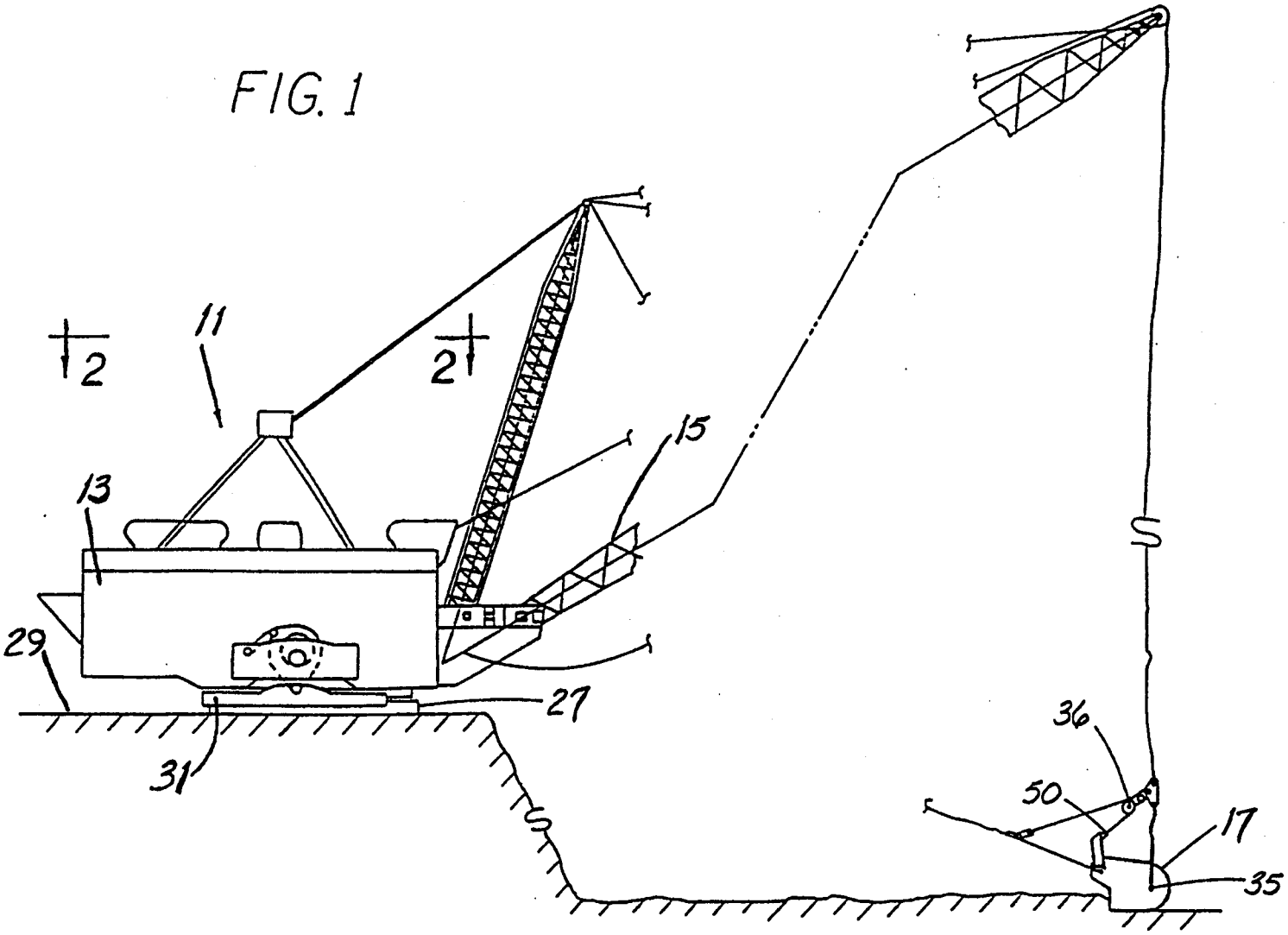
FIG. 1 is a representative side elevation view of a dragline having a bucket of the type on which the inventive bucket arch is used.
Figure 2:
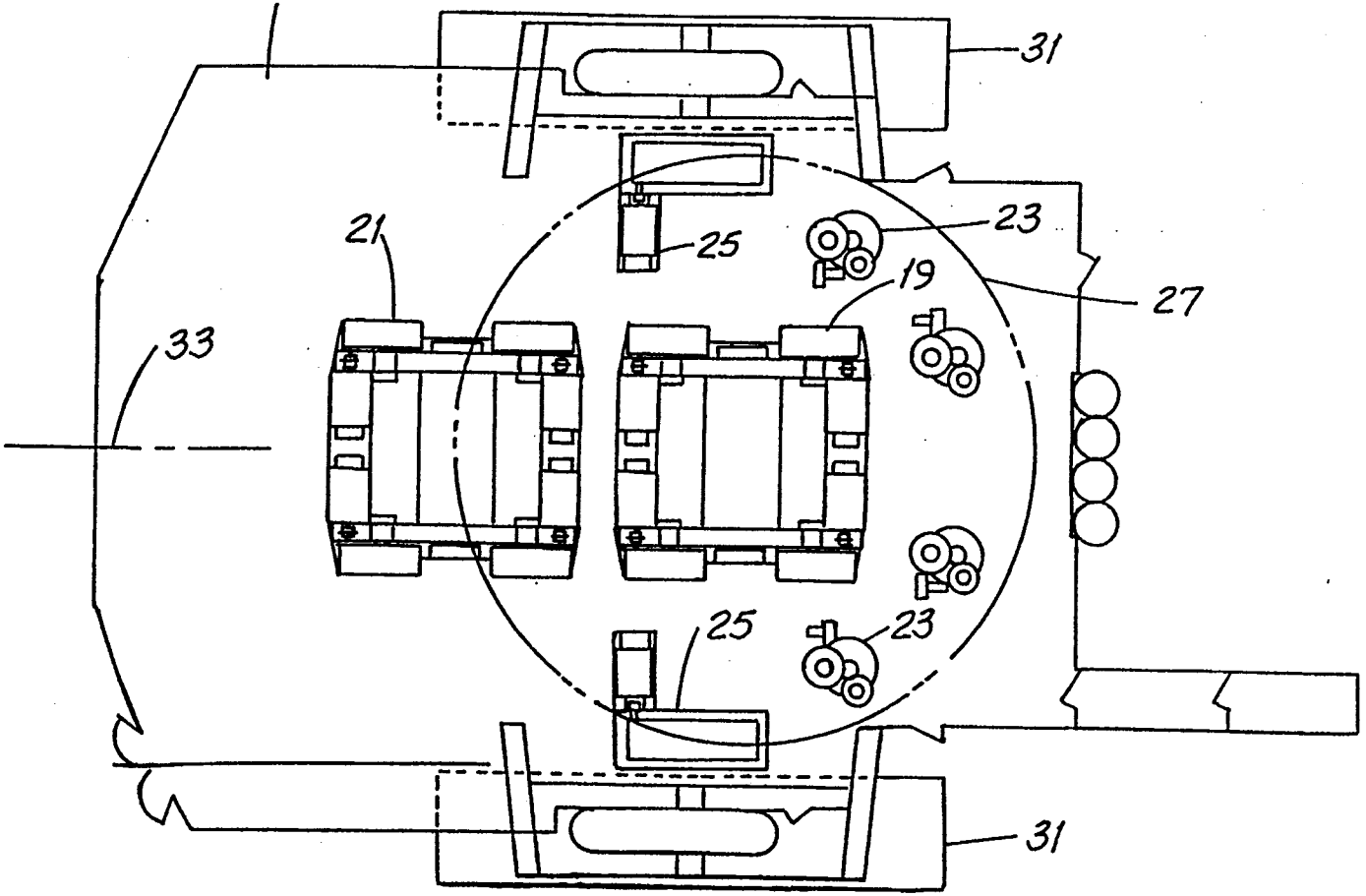
FIG. 2 is a representative top plan view of the main housing portion of the dragline of FIG. 1 taken along the viewing plane 2—2 thereof. Parts are broken away and certain surfaces of other parts are shown in dashed outline.
Figure 8:
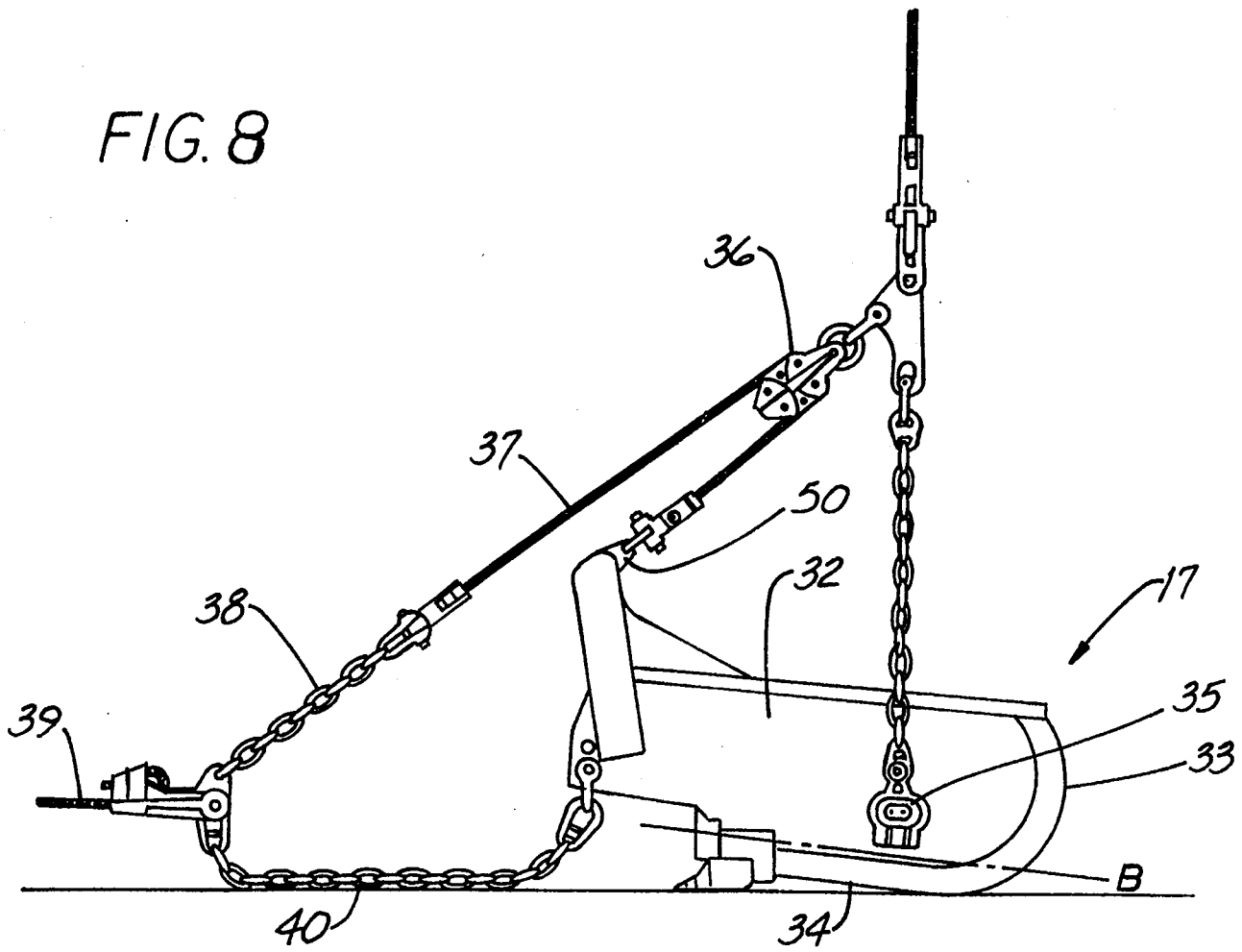
FIG. 8 is a representative side elevation view of a bucket including the inventive arch and the various rope and chain attachments.

Referring first to FIGS. 1 and 2, the walking dragline 11 includes a main housing portion 13 having a boom 15 extending therefrom to support and manipulate a digging bucket 17 as best seen in FIG. 8.

Within the housing portion 13 are mounted the bucket hoist, bucket drag and swing systems 19, 21 and 23, respectively. The drive 25 for the "walking" system is also mounted therein. When digging, the dragline 11 sits on and pivots about a generally circular "tub" or platform 27 which rests on the earth's surface 29.

The dragline 11 also includes a pair of pads or "shoes" 31 which, when moved in unison, lift the platform 27 and move the dragline 11 rearwardly away from the bucket 17. Movement in the exemplary dragline 11 is in "steps" of about 7 feet in length and along the long axis 33 of the main housing portion 13.

In the exemplary large dragline, the main housing portion 13 is about 105 feet long, about 80 feet wide, about 40 feet high and weighs about 9 million pounds. The boom 15 extends about 300 feet and the capacity of the digging bucket 17 is about 80 cubic yards. As best seen in FIG. 8 the digging bucket 17 includes a pair of sides 32, a back portion 33 and a bucket floor 34. The bucket 17 further includes a bucket axis B that extends the length of the bucket 17 and parallel to the bucket floor 34. Of course, it is to be appreciated that the inventive dump bucket arch 10 is well adapted for use with draglines and digging buckets of varying size irrespective of the particular manufacturer.

Before describing details of the inventive bucket arch, it will be helpful to have an understanding of how a dump bucket is attached to and manipulated by the dragline. A description of how the bucket is emptied and of features of the invention which help reduce wear on the arch and the drag chain is set forth following the detailed description of the structural features of the new arch.

A hoist rope is supported by the boom and is attached by a clevis to a double-leg hoist chain. The rope and the chain resemble an inverted "Y" in shape. The lower end of each leg of the chain is attached to a separate side of the bucket by a trunion 35.

A pulley-like dump block 36 is also attached to the clevis and includes a dump rope 37 threaded therethrough. One end of the dump rope 37 is secured to the lug 50 and the other end is secured to a dump chain 38. The dump chain 38 is secured to one end of a drag rope, the other end of which is attached to the dragline. In a manner somewhat like a common fishing casting reel, the dragline "retrieves" the drag rope (when drawing the bucket toward the dragline while digging) and pays out the rope when "casting" the bucket after it has been emptied. A drag chain 40 is attached to the bucket sides 32 and is attached to the drag rope 39 at the other end thereof.

Figure 3:
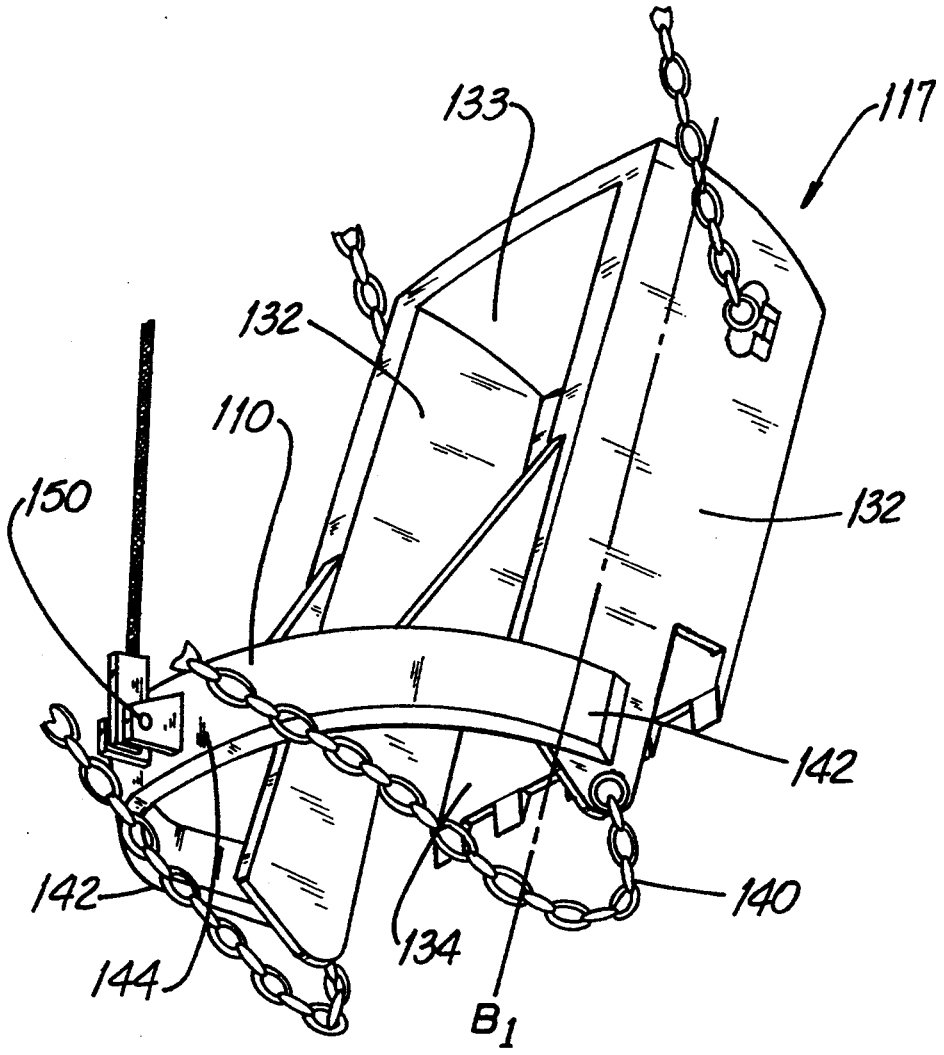
FIG. 3 PRIOR ART
FIG. 3 is a perspective view of a prior art dragline bucket and arch arrangement.
Figure 4:
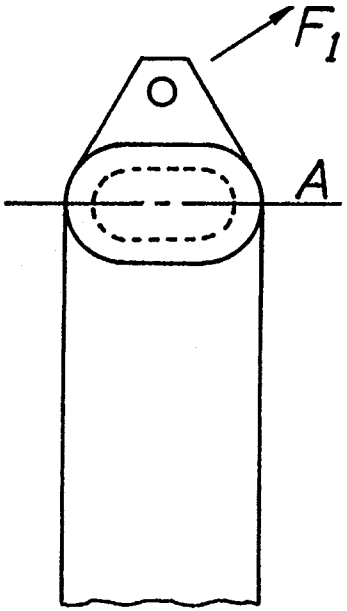
FIG. 4 PRIOR ART
FIG. 4 is a cross-sectional view of a prior art bucket arch illustrating the location of the dump rope lug on the arch.

As best seen in FIGS. 3 and 4, a prior art bucket 117 includes a pair of sides 132, a back portion 133 and a bucket floor 134. The bucket 117 further includes a bucket axis $B_l$ that extends the length of the bucket 117 parallel to the bucket floor 134. A bucket arch 110 is attached to each side 132 of the digging bucket. The prior art bucket arch 110 includes a pair of arch side sections 142 and an arch center section 144 extending between the side sections 142. The arch center section 144 includes a lug 150 secured thereto which attaches a dump rope 37 to the arch center section 144. The dump rope 37 applies a force along a force axis $F_1$. Such a force axis $F_1$ is angled with respect to the axis "A" extending through the arch. Such force being applied in an angled direction causes stress and twisting of the bucket arch 110 of the prior art. Such forces can, over time, permanently distort or even break the arch. And as shown in FIG. 3, when the digging bucket 117 is in the tipped position, the drag chain 140 contacts the arch center section 144 along an edge thereof. The drag chain 140 grates along and abrades such edge and weakens the arch 110. Very possibly, such abrasion can result in a fracture.

Figure 6:
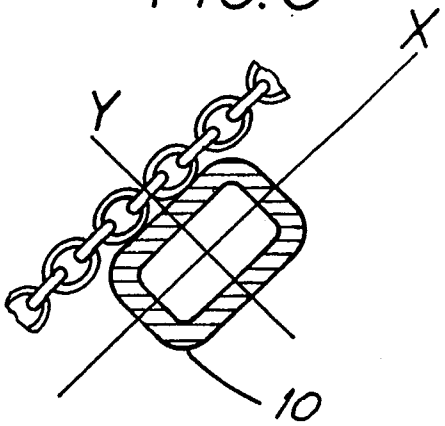
FIG. 6 is a cross-sectional view of an embodiment of the inventive arch illustrating a leg of the drag chain in contact with the arch when the bucket is in a dumped position.
Figure 5:
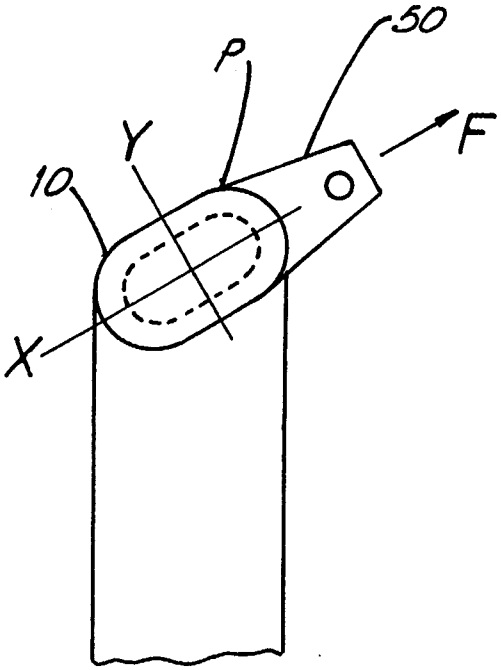
FIG. 5 is a cross-sectional view of a bucket arch of the invention illustrating structural features of the arch and the location of the dump rope lug on the arch.
Figure 7A:
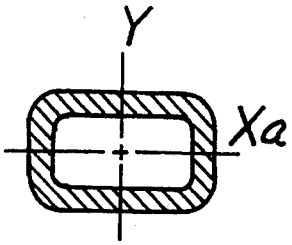
FIG. 7A is a cross-section view of the bucket arch shown in FIG. 7 taken along plane A—A thereof.
Figure 7B:
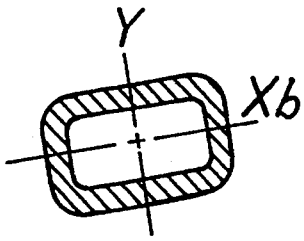
FIG. 7B is a cross-section view of the bucket arch shown in FIG. 7 taken along plane B—B thereof.
Figure 7C:
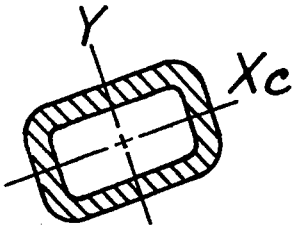
FIG. 7C is a cross-section view of the bucket arch shown in FIG. 7 taken along plane C—C thereof.
Figure 7E:
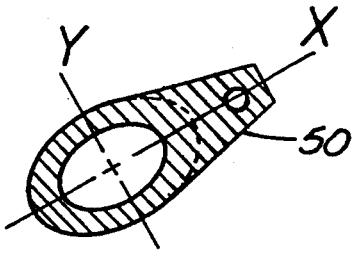
FIG. 7E is a cross-section view of a slightly different embodiment of the bucket arch shown in FIG. 7, i.e., an arch having an oval cross-sectional shape.
Figure 7D:
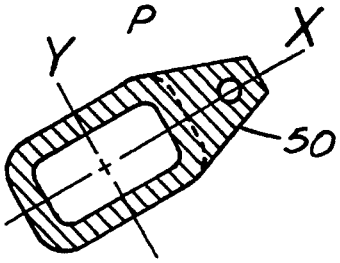
FIG. 7D is a cross-section view of the bucket arch shown in FIG. 7 taken along plane D—D thereof. The view of FIG. 7D corresponds generally to the view of FIG. 5.
Figure 7:
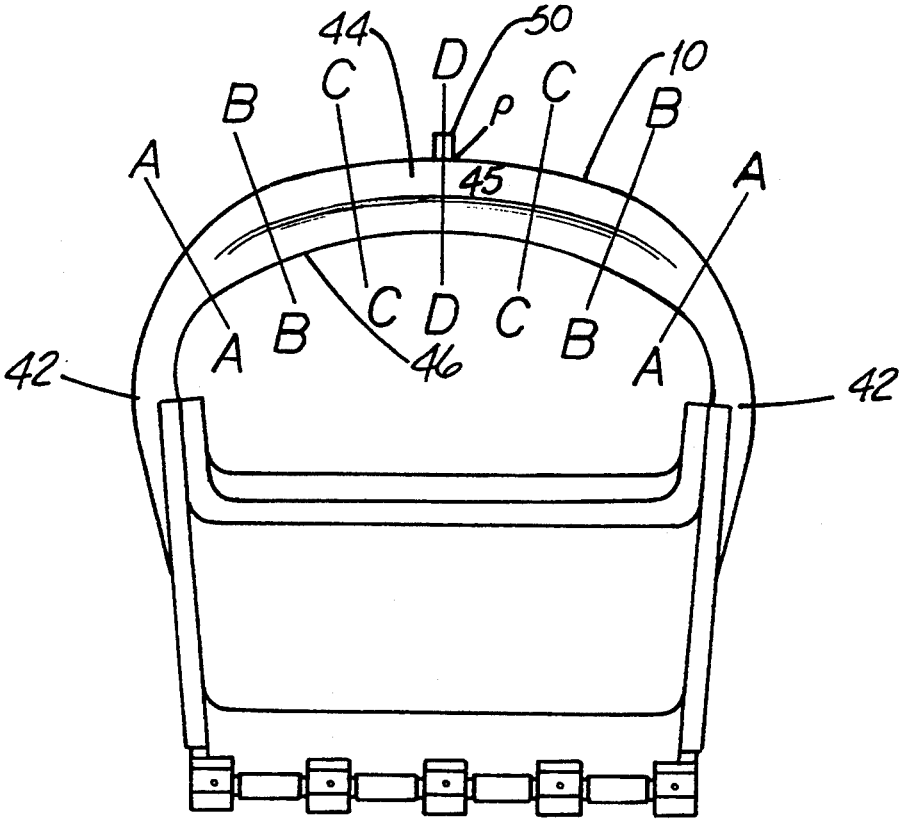
FIG. 7 is an elevation view looking into the open mouth of a dragline bucket. The bucket is equipped with the inventive arch.

Referring next to FIGS. 5, 6 and 7, which show the bucket arch of the present invention, the bucket arch 10 includes a pair of arch side sections 42 and an arch center section 44 disposed therebetween. The arch center section 44 includes a top surface 45 and a bottom surface 46. Further, the center section 44 has at least one lug 50 attached thereto which exerts a force along a force axis F. While only one lug is shown in FIG. 7, the number of lugs is generally dependent on the size of the bucket and either one or two lugs are commonly used. The arch center section 44 is angled with respect to the bucket floor 34 and the bucket axis B. At a point of lug attachment P, the arch center section 44 has a first axis X generally coincident with the force axis F and a second axis Y generally perpendicular to the first axis X. As can best be appreciated by considering FIG. 7 and comparing FIGS. 7A–7D, the arch center section 44 is gradually angled with respect to the bucket floor 34 and the bucket axis B.

To put it another way, the first axis Xa (FIG. 7A) at an arch side section is generally parallel to the floor. In cross-section views taken progressively closer to the lug, FIGS. 7B and 7C, respectively, the first axes Xb and Xc, respectively, become more angled with respect to such floor. In the cross-section view taken at the lug (i.e., that location where the rope applies force to the arch along the force axis F) the first axis X is generally coincident with the force axis F and is at an angle with respect to the bucket axis and the bucket floor. In one specific arrangement, the angle between the first axis X and the bucket axis B is about 30°. However, those of ordinary skill in the art will recognize that some other angle may be dictated by the specific bucket shape and geometry of the bucket suspension arrangement.

The foregoing arrangement has an important salutary effect on the life of the arch and of the drag chain. A comparison of FIGS. 4 and 5 helps appreciate why this is true.

In the arrangement of FIG. 4, the force applied by the dump rope along the axis $F_1$ tends to "torque" or twist the arch center section in a clockwise direction. This causes what are known as "stress risers" or regions of high stress in the arch. Such dump rope force also has a greater tendency to bend the arch.

In the inventive arrangement of FIG. 5, twisting forces on either side of the lug 50 are at least greatly reduced because the force applied to the arch by the dump rope is applied parallel to the axis X of the center section 44. Therefore, there is little tendency for such force to twist the arch. And in the inventive arrangement, the force applied by the dump rope is substantially coincident with the long first axis of the arch, i.e., in a direction in which the arch is most resistant to bending.

As can best be seen in FIGS. 5, 7D and 7E, the arch center section may have an elliptical (FIG. 5), oval (FIG. 7E) or rectangular (FIG. 7D) cross-section. In any of the specific illustrated cross-sections, the dimension of the bucket arch is greater along the first axis X than along the second axis Y. And for any of the illustrated embodiments of the arch 10, the cross-sectional shape is symmetrical about the first axis X and the second axis Y.

If a rectangular cross-section is used, it is preferred that the corners (the "edges" of the arch) are rounded. This helps reduce stress concentration and presents an edge to the drag chain which is much less likely to quickly wear such chain. Additionally, the arch is preferably hollow and may be cast or fabricated from suitably shaped plate.

In operation, when the bucket 17 is being dragged to fill the bucket with overburden, a force is applied to the drag rope 39 and drag chain 40. When the bucket 17 is lifted, force is also applied to the hoist rope and the hoist chain while keeping the drag rope taut.

When the bucket 17 is positioned over a waste pile onto which the bucket contents are to be emptied, the force exerted on the drag rope 39 is released. The geometry of the bucket 17 and the attachment of the hoist chain thereto is such that when the drag rope is released, the weight of the bucket and its contents causes the bucket to pivot around the trunions 35 into a vertical position, thereby dumping the contents.

As shown in FIG. 6, when the bucket 17 is in the tipped position, the drag chain 40 contacts the arch center section 44 and, more specifically, bears across the top surface 45 of the center section and is oriented generally parallel to the first axis X. The benefit of this arrangement is better appreciated by a comparison of FIG. 6 and of the drag chain in contact with the arch edge in the prior art arrangement of FIG. 3.

In the prior art arrangement, grinding, abrading wear on the drag chain and arch is concentrated at "points" of contact, is frequently severe and leads to premature failure. In the inventive arrangement, a relatively smooth, large-area surface is presented to the drag chain and wear on both the chain and the arch is materially reduced.

Various features of the invention have been particularly shown and described in connection with the illustrated embodiments of the invention. However, it should be understood clearly that these embodiments are exemplary and the invention is not limited thereby.

What is claimed is:

1. In a dragline bucket assembly including (a) a bucket having a bucket floor, and a back portion (b) an arch rigidly mounted to the bucket and having a pair of side sections and an arch center section disposed therebetween and having a cross-sectional shape, (c) at least one lug attached to the arch center section and exerting a force on the arch center section along a force axis, and (d) a dump rope attached to the lug, the improvement wherein, when the bucket floor is generally horizontal:

the arch center section is angled with respect to the side sections; and, the lug is angled rearwardly towards the back portion of the bucket at an acute angle with respect to a horizontal plane;

the force axis (a) extends through the arch center section and the lug, and (b) is generally coincident with the dump rope, and (c) is angled at an acute angle with respect to the horizontal plane, whereby application of twisting forces to the arch center section are substantially avoided.

2. The assembly of claim 1 wherein:

the arch center section has a first axis generally coincident with the force axis and a second axis substantially perpendicular to the first axis;

in cross-section, the dimension of the arch center section along the first axis is greater than the dimension of the arch center section along the second axis.

3. The assembly of claim 1 wherein:

the arch center section has an upper surface, a lower surface, and a first axis generally coincident with the force axis and positioned generally midway between the upper and lower surfaces.

4. The assembly of claim 3 wherein:

the center section is substantially rectangular in shape.

5. The assembly of claim 4 wherein:

the center section has rounded corners.

6. The assembly of claim 1 wherein:

in cross-section, the arch center section defines an ellipse having a major axis; and the force axis is generally coincident with the major axis.

7. The assembly of claim 1 wherein:

in cross-section, the arch center section defines an oval having a major axis; and the force axis is generally coincident with the major axis.

* * * * *